US005100149A

United States Patent [19]

Olfman et al.

[11] Patent Number: 5,100,149

[45] Date of Patent: Mar. 31, 1992

[54] THREE LEVEL GAME BOARD

[75] Inventors: Shawn D. Olfman; Jerry A. Olfman, both of Winnipeg, Canada

[73] Assignee: Olfman Brothers Incorporated, Winnipeg, Canada

[21] Appl. No.: 648,026

[22] Filed: Jan. 30, 1991

Related U.S. Application Data

[60] Continuation of Ser. No. 492,495, Mar. 12, 1990, abandoned, which is a continuation of Ser. No. 183,069, Apr. 19, 1988, abandoned, which is a division of Ser. No. 625,118, Jun. 27, 1984, abandoned.

[30] Foreign Application Priority Data

Jun. 30, 1983 [CH] Switzerland ..... 431646/83

[51] Int. Cl.[5] ..... A63F 3/00

[52] U.S. Cl. ..... 273/241; 273/287

[58] Field of Search ..... 273/241, 287, 260, 261

[56] References Cited

U.S. PATENT DOCUMENTS 3,656,756 4/1972 Gribbon ..... 273/241

4,534,565 8/1985 Hube ..... 273/241

*Primary Examiner*—Benjamin Layno

[57] ABSTRACT

A three level game board made up of a lowermost level, a middle level, and an uppermost level. The playing area of the lowermost level is made up of four stepped pyramidal shaped component playing areas each of which, when the game board is set up for its intended use, lies entirely outboard of the playing areas of the other two levels a sufficient distance to be adequately observable by Players. The playing area of the middle level is substantially square shaped and centrally located entirely within the four component playing areas of the lowermost level. The playing area of the uppermost level is in the shape of a square that has had a stepped pyramidal shaped portion taken centrally out of each of its sides such that a stepped pyramidal shaped recess is left centrally located in each of its sides and which uppermost level's playing area is centrally located entirely within the four component playing areas of the lowermost level and is vertically spaced above the playing areas of the middle and lowermost levels an appropriate distance such that the playing areas of the middle and uppermost levels are easily viewable by Players positioned to play the game for which the game board was made.

12 Claims, 4 Drawing Sheets

THREE LEVEL GAME BOARD

This is a continuation application of patent application Ser. No. 07/492,495, filed Mar. 12, 1990, now abandoned which was a continuation application of patent application Ser. No. 07/183,069, filed Apr. 19, 1988, now abandoned which was a divisional application of patent application Ser. No. 625,118, filed Jun. 27, 1984, now abandoned.

BACKGROUND OF THE INVENTION

1. Field of the Invention

This invention relates generally to the game board art and more specifically to a new utilitarian design for the playing areas of three level game boards and for three level game boards; and to a new way to construct three level game boards.

2. Description of the Prior Art

Three level game boards have been known for many years. Many of the known three level game boards, however, that have large numbers of playing positions on each of their levels, have been designed for use with playing pieces that have a small height dimension (e.g. for use with checker sized playing pieces, little balls, or other similar minimal height type playing pieces). See for example U.S. Pat. No. 3,399,895, issued to Alice L. Beach, or U.S. Pat. No. 4,184,685, issued to David A. D. J. Wilson.

However, when designing a three level game board for use with playing pieces that have a relatively large height dimension, there are problems that must be overcome, these problems often arise because there is a limit to the total height that a game board can be built if it is to be placed on a table, and people are to play the game from seated positions around the table.

Many of the prior art game boards involved vertically aligning and vertically spacing each of the levels of the game board. However, vertically aligned and vertically spaced game boards, often must have their levels spaced far enough from each other to allow a player to observe all of the lower levels, and to be able to maneuver the playing pieces on the lower levels with his hands. Additionally, however, such game boards often must not have their levels spaced vertically so far apart that the top level is above the field of vision of the players positioned to play the game. The two aforesaid requirements present a problem when the playing pieces that are to be used with the game board have a relatively large height dimension (i.e. the higher the playing pieces the farther apart the levels must be spaced, however, as the levels are spaced farther apart the top level becomes increasingly higher above the surface on which the game board is placed). For example, if a person is seated at a table to play the game, and that person's seated eye level is twenty inches above the surface of the table, then if the height of the playing surface of the top level of the game board is greater than twenty inches, that person will not be able to easily see the playing surface of the top level of the game board from his seated position. One of the methods that the prior art has used to overcome the above stated problem, is to construct the game board's upper levels out of a transparent material. However, requiring the material to be transparent limits the types of material that can be used, which is a problem for people who want to use the many non-transparent materials available; additionally, many transparent materials have inherent problems, glass for example is usually easily breakable, and plastic for example is usually easily scratched.

Some prior art game boards were constructed such that the vertically spaced levels were horizontally staggered. A horizontal staggering of the vertically spaced levels can result in a reduction in the number of people that can be placed around the game board such that each person has equal access to each level of the game board.

Some prior art game boards have been constructed with one or more of the levels moveable out of vertical alignment with the other levels. An inherent problem with this type of construction is that the game playing pieces which are on the level that is being moved are liable to be knocked over by the movement, unless they are attached to that level. However, if the playing pieces are to be attachable to the moveable level a more complicated construction is involved then if they can be allowed to freely rest on that level. Secondly, if it is not a requirement or advantage of the game that only a portion of the game board is visible at any one time, then two other problems are caused by a moveable level. Firstly, the game is interrupted by the movement of the level, and secondly, the players can only observe a portion of the game at any one time, as the moveable level must be moved to allow the other levels to be clearly seen.

Other prior art game boards have consisted of a number of levels each of which has only a small number of playing positions on it, which is a problem for persons creating games that require levels with a large number of playing positions on them.

BRIEF SUMMARY OF INVENTION

Herein, wherever used, a "playing position" is defined to mean the smallest meaningful identifiable portion of a level of a game board in association with which a playing piece is intended to be placed in the course of playing any of the games for which the game board is designed. For example, in a chess game each of the squares on the chess board is a playing position. However, a portion of a chess board square is not a playing position, since it is not relevant to the game of Chess where within a chess board square a chess piece is located; all that matters is which chess board square the chess piece is in. Accordingly, each chess board square is a playing position, but no smaller division of a chess board is a playing position.

Herein, wherever used, the "playing area" of a level of a game board is defined to mean all of the playing positions on that level.

Herein, wherever used, a "component playing area" of a level of a game board is defined to mean an identifiable portion of the playing area of that level which is less than the total playing area of that level and which is visually separated from the remaining playing area(s) of that level.

Herein, wherever used, a "non-playable location" is defined to mean a portion of a level of a game board that does not have any playing positions associated with it.

An object of the present invention is to provide a three level game board most of the playing area of which can be easily seen by all players positioned to play the game, which is suitable for use with playing pieces having a relatively large height dimension, and which allows for game boards to be built in which each of the levels has a large number of playing positions on it. Another object of this invention is to provide a three level game board that can be built out of many different kinds of materials.

The present invention provides a three level game board comprised of: a lowermost level; a middle level; and an uppermost level. In the game board of the present invention the playing area of the lowermost level is made up of four stepped pyramidal shaped component playing areas each of which, when the game board is set up for its intended use, lies entirely outboard of the playing areas of the other two levels a sufficient distance to be adequately observable by Players. Further, in the game board of the present invention the playing area of the middle level is substantially square shaped, and is centrally located entirely within the four component playing areas of the lowermost level. Further, in the game board of the present invention the playing area of the uppermost level is in the shape of a square that has had a stepped pyramidal shaped portion taken centrally out of each of its sides such that a stepped pyramidal shaped recess is centrally located in each of its sides. The uppermost level is centrally located entirely within the four component playing areas of the lowermost level and is vertically spaced above the playing areas of the middle and lowermost levels a suitable distance such that the middle and uppermost levels are easily viewable by Players positioned to play the game for which the game board was intended. Further, the four component playing areas of the lowermost level are adapted to lie outboard of the middle and uppermost levels' playing areas when the game board is set up for its intended use in such a manner that if a first of said component playing areas is said to be lying entirely to the north of the middle and uppermost levels' playing areas, then a second of said component playing area is lying entirely to the east of the middle and uppermost levels' playing areas and a third of said component playing areas is lying entirely to the south of the middle and uppermost levels' playing areas, and the fourth of said component playing areas is lying entirely to the west of the middle and uppermost levels' playing areas.

One advantage of the game board design taught by the present invention is that it allows three level game boards to be constructed out of many different kinds of non-transparent and transparent materials. A second advantage of the present invention is that each of the three levels of the game board can have a large playing area, however, the total height of the game board may be as low as would be required for only a two level game board, accordingly, Players positioned to play the game are not caused difficulty in observing substantially all of each of the playing areas of each of the three levels of the game board. A third advantage to the present invention is that it allows three level game boards to be constructed wherein the game board can be used with playing pieces having a large height dimension without the need of staggering the levels, or of making one of the levels moveable, or of making the total height of the game board such that the top level's playing surface can not be easily seen by a person of normal height seated at a table on which the game board has been placed. A fourth advantage of the present invention is that it allows three level game boards to be constructed wherein at least four people can be positioned around the game board such that each person has equal access to each level of the game board.

DESCRIPTION OF THE PREFERRED EMBODIMENT

Figure 1:
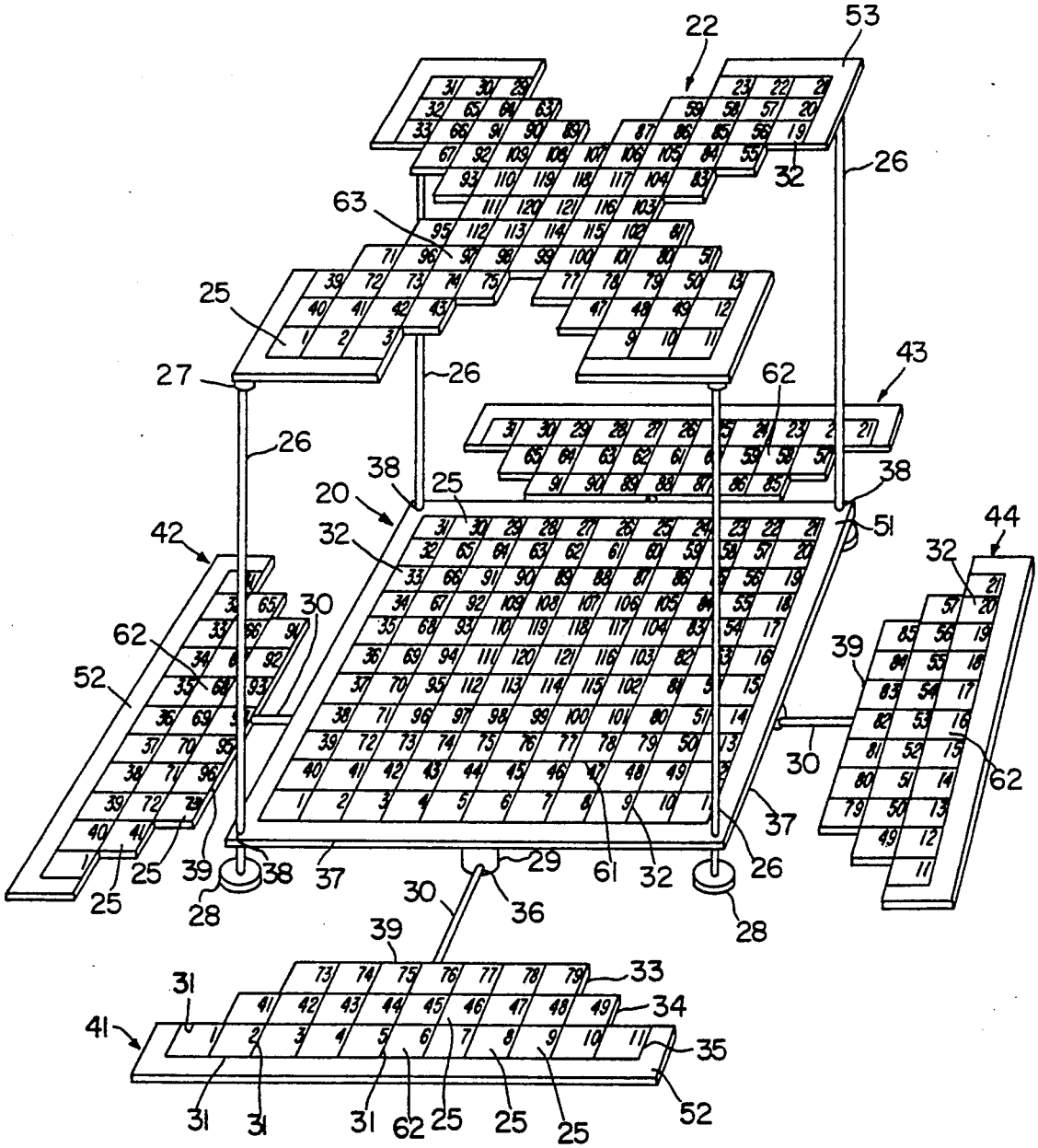
FIG. 1 is a perspective view of a preferred embodiment of a three level game board according to the invention.

Referring now to the drawings in detail wherein the showings are for the purpose of illustrating the invention and not to limit the invention; FIG. 1 illustrates a preferred embodiment of a three level game board according to the invention. The game board is comprised of three levels: a first level having a playing area that lies outboard of the playing areas of the second and third levels, which first level is comprised of component parts 41, 42, 43, and 44; a second level 20; and a third level 22 which is partially cut-away. Each level is comprised of a bordering area, 52, 51, and 53 respectively, a playing area, 62, 61 and 63, respectively, and playing positions 25, of which the playing areas are comprised. The game board is further comprised of four substantially identical support poles 26, four substantially identical pole sockets 27, four substantially identical pole bases 28, four substantially identical legs 29, and four substantially identical spacer rods 30.

The terms "pyramidal shape", or "pyramidal shaped, or "pyramidal configuration" or "pyramidal form", as used anywhere herein, are defined to mean a shape or configuration or form which has a longer end, a shorter end, and sides that go inwardly from its longer end to its shorter end, wherein the longer end is called the bottom or back and the shorter end is called the top or front. The terms "stepped pyramidal shape", or "stepped pyramidal shaped", or "stepped pyramidal configuration" or "stepped pyramidal form" as used anywhere herein, are defined to mean a pyramidal shape, or configuration, or form, in which at least a portion of each of its sides is substantially step like.

On each of the levels the playing positions 25 are all substantially the same size and are all of a substantially square configuration and are defined by the boundary lines 31. Each playing position contains a number 32 located adjacent the interior of its upper right hand corner. All of the playing positions on a given level taken together define the playing area of that level.

The playing area of the first level is composed of the playing areas of each of its component parts, 41, 42, 43 and 44. All of the playing positions on a component part of the first level are known as a component playing area. Each of the four component playing areas of the first level are defined by an outermost row 35 of eleven playing positions, a middle row 34, of nine playing positions, centrally located adjacent the inside edge of the outermost row of eleven playing positions, and an innermost row 33, of seven playing positions, centrally located adjacent the inside edge of the middle row.

The playing area of the second level is of a substantially square configuration, the playing positions being arranged in adjacent rows and columns of eleven playing positions each.

The playing area of the third level is composed of the playing positions 25 of the third level, said playing area would be substantially square in shape if it were not that the outer central portions of the playing area are absent a stepped pyramidal configuration of playing positions. The playing area of the third level is defined by eighty-five of said playing positions which are arranged into a first row which has three adjacent playing positions, a central aperture the length of five playing positions and then three more adjacent playing positions, a second row which has four adjacent playing positions, a central aperture the length of three playing positions and then four more adjacent playing positions, a third row which has five adjacent playing positions, a central aperture the length of one playing position and then five more adjacent playing positions, a fourth row of nine adjacent playing positions, a fifth row of seven adjacent playing positions, a sixth row of five adjacent playing positions, a seventh row of seven adjacent playing positions, an eighth row of nine adjacent playing positions, a ninth row which has five adjacent playing positions, a central aperture the length of one playing position and then five more adjacent playing positions, a tenth row which has four adjacent playing positions, a central aperture the length of three playing positions and then four more adjacent playing positions, and an eleventh row which has three adjacent playing positions, a central aperture the length of five playing positions and then three more adjacent playing positions. Wherein each of the second to eleventh rows, inclusive, is centrally located adjacent to the inside edge of the row that precedes it.

The second level 20 is supported a fixed distance above the surface on which it rests by the four substantially identical legs 29, which are cylindrical in shape with a flat bottom and having a cylindrical recess 36 in their sides near their bottom. The legs 29 are attached either permanently or removably to the bottom of the second level such that one of the four legs 29 is centrally located near each of the four edges 37 of the second level, and such that the mouth of the recess 36 is facing outwardly and is parallel with the plane defined by the edge of the second level which it is nearest. The height of legs 29 determines the distance that the second level is above the surface on which it rests.

The bordering areas, 52, 51 and 53, are all of substantially the same width, said width being greater than the cross sectional diameter of one of the support poles 26.

Centrally located within each of the four corners of the bordering area 51 of the second level is a circular aperture 38 having a diameter such that one of support poles 26 may pass closely through it.

Centrally located beneath each of the four outermost corners of the third level is a cylindrical support pole socket 27, which may be either permanently or removably attached to the bottom of the third level and which has a recess centrally located within its bottom of sufficient diameter to allow a support pole 26 to closely fit within it.

Support pole bases 28 are essentially discs of substantially greater diameter than the cross-sectional diameter of support poles 26, having a flat bottom, and having a cylindrical central recess in their tops of a diameter to allow a support pole 26 to closely fit within.

Each component part of the first level has a centrally located cylindrically shaped recess in its front edge 39.

Each of the spacer rods 30 consists of a first cylindrical portion having a cross-sectional diameter such that it will closely fit within a recess 36 of a leg 29, and of a length equal to the depth of a recess 36, a second cylindrical portion having a greater cross-sectional diameter than that of the first cylindrical portion, and a third cylindrical portion of a cross-sectional diameter to closely fit within the recess in the front edge of the component parts of the first level and of a length equal to the depth of the just said recess. The length of the second cylindrical portion shall be given later.

The height of support poles 26 and the height of legs 29 determines the vertical distance between the third level and the second level. In the embodiment of a game board according to the present invention illustrated in FIG. 1 the height of the legs is chosen to raise the second level above its supporting surface, but not greatly above it. The height of support poles 26 is chosen to raise the third level above the second level a suitable distance such that a person positioned to play the game would be easily able to observe the entire playing area of the third level, but also would have easy access to the playing areas of the second and third levels, as well as being easily able to observe the playing area of the second level; some head and neck movement may of course be required.

Support poles 26 being all the same height and legs 29 being all the same height the second and third levels will lie in vertical spaced relation to each other and their supporting surface and be parallel to each other and their supporting surface, presuming the supporting surface is relatively flat.

Each of the component parts of the first level is placed opposite the side of the second level to which its playing positions correspond, as hereinafter defined, in central horizontal alignment with that side of the second level.

The length of the second cylindrical portion of the spacer rods 30 is such that when the component parts of the first level are connected to the legs 29 of the second level the said component parts are a sufficient distance outboard of the second level that they can be easily viewed by any of the players positioned to play the game, although some head and neck movement may be required.

The component parts of the first level are connected to the legs 29 by the first cylindrical portion of the spacer rods being plugged into the recesses of the legs 29 and the third cylindrical portion of the spacer rods being plugged into the recesses of the front edges of the component parts of the first level. The said component parts have a flat bottom on which they rest on their supporting surface.

The third level is supported in vertically spaced alignment above the second level and parallel with the second level such that the playing positions of the third level are vertically aligned with the playing positions of the second level with which they correspond, as hereinafter defined. The third level is supported in the aforesaid position by the support poles 26, which fit slidably into the recesses in pole sockets 27, and then pass through the apertures 38 in the second level and slidably fit into the recesses in the tops of the pole bases 28, upon which they rest.

It is not essential that any or all of the support poles, legs, pole sockets, pole bases, or spacer rods be permanently attached in the positions they occupy when the game board is assembled. However, for ease of assembly and disassembly it is suggested to permanently attach the support pole bases to the support poles, the pole sockets beneath the corner junctures of the third level as aforesaid, and the legs beneath the second level as aforesaid. The game board can then be taken apart to consist of four support poles with pole bases attached, four spacer rods, four component parts of the first level, the second level with legs attached and the third level with pole sockets attached. The game board can easily assembled by first inserting the support poles through the apertures 38 of the second level, then setting down the second level and poles with pole bases attached on the supporting surface then placing the third level on the supporting poles by means of the pole sockets and connecting the component parts of the first level to the legs of the second level by the spacer rods as aforesaid. To disassemble the game board reverse the aforesaid procedure.

Figure 3:
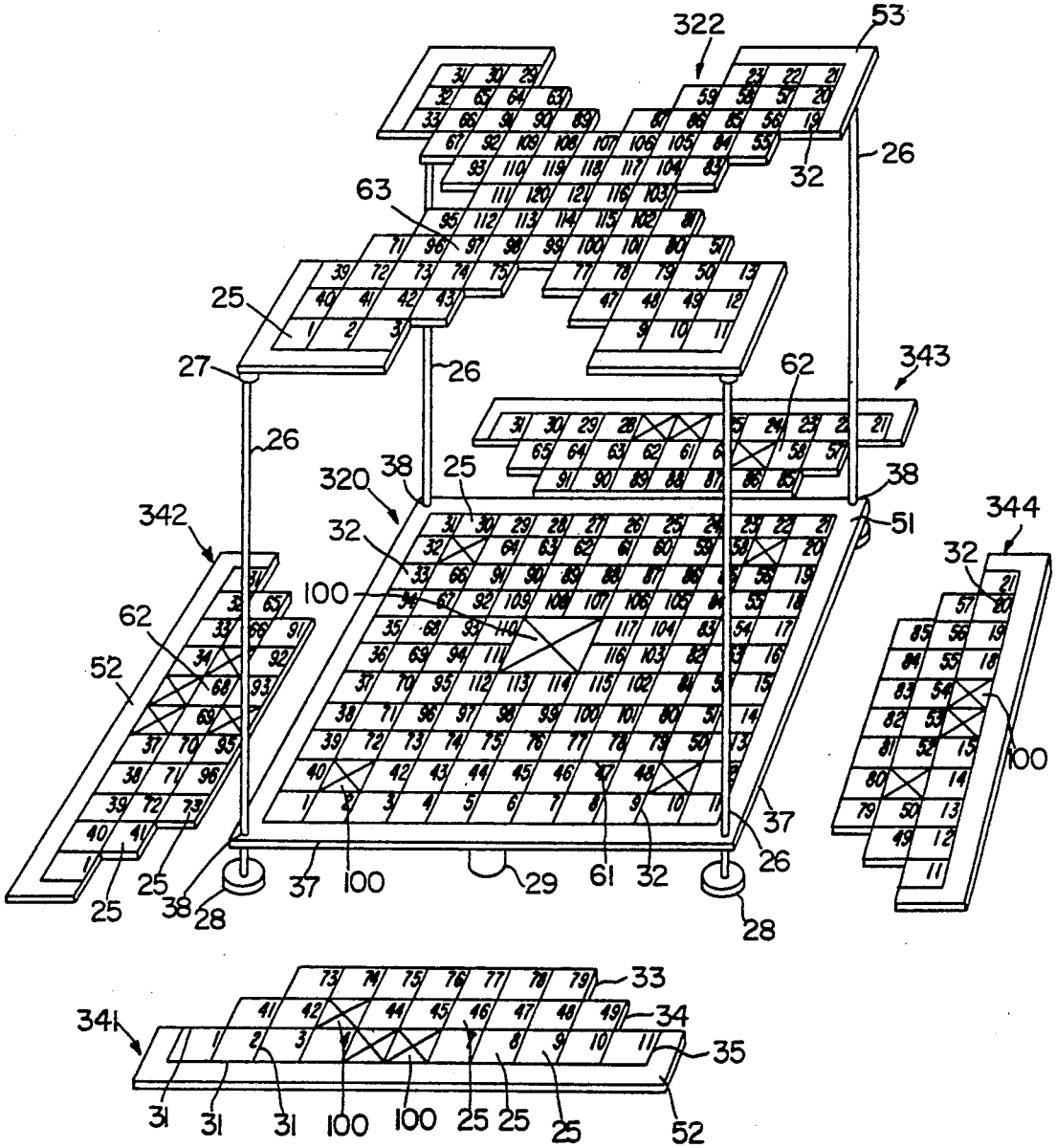
FIG. 3 is a perspective view of a third embodiment of a three level game board according to the invention.

When constructing the game board the sizes of the playing pieces that are to be used with the game board should be kept in mind if it is desired to make the dimensions of playing positions 25 such that no matter which of the game playing pieces are placed centrally within any of the playing positions, the playing piece can leave uncovered the number 32. The numbers 32 illustrated in FIGS. 1 and 3 are not drawn to scale, in the actual embodiments said numbers 32 would only occupy the upper right hand eighth of a playing position. When constructing a preferred embodiment, as illustrated in FIG. 1, the playing positions are large enough such that any of the playing pieces that are to be used with the game board may be placed in a playing position without touching the upper right hand eighth of the playing position which is occupied by the number of the playing position. Accordingly, a playing piece may be placed within a playing position and leave the number in the upper right hand corner entirely uncovered.

The number 32 that is in the upper right hand corner of each of the playing positions 25 on the second level is unique, on the second level, to the playing position on the second level which it is in.

In the upper right hand corner of each of the playing positions 25 on the third and first levels is the identical number in substantially the same size, as the number in the playing positions 25, of the second level, to which the playing positions 25 on the third and first levels correspond.

A playing position on the third level is deemed to correspond to the playing position on the second level with which it is in vertical alignment when the central twenty-five playing positions of the third level are vertically aligned with the central twenty-five playing positions of the second level and the third level is vertically aligned with the second level, and the playing area of the third level is facing in the same direction as the playing area of the second level, and with each of said central twenty-five playing positions of the third level aligned with the same playing positions of the second level with which they were aligned when it was previously determined which playing positions of the third level corresponded to which playing positions of the second level, if such a determination was previously made.

A playing position of a component part of the first level is deemed to correspond to the playing position on the second level with which it would be vertically aligned if that component part of the first level were placed with its playing positions in vertical alignment with twenty-seven playing positions of the second level, and with its playing area facing in the same direction as the playing area of the second level, and its back eleven playing positions aligned with the eleven playing positions most nearly adjacent one of the edges 37 of the second level, and with each of said back eleven playing positions of the component part of the first level aligned with the same playing positions of the second level with which they were aligned when it was previously determined which playing positions of the first level corresponded to which playing positions of the second level, if such a determination was previously made.

The preferred embodiment of the present invention has many advantages.

The game board may be quickly and easily assembled or disassembled. When disassembled the game board occupies very little space compared to the space it occupies when it is assembled. Because the playing area of the first level lies outboard of the playing areas of the second and third levels, or central levels, the height of the entire game board need not be so great that the playing area of the third level is above the field of vision of a player positioned to play the game, and yet the vertical spacing between the second and third levels may still be made great enough such that none of the second level's playing positions are obscured from the view of any player positioned to play the game.

Contrastingly, if the three levels were constructed to lie in vertical alignment it can be seen that the vertical distance between the first and second levels might have to be approximately the same as the vertical distance between the second and third levels if the playing pieces are not to have a minimal height dimension and if the playing areas of the first and second levels are to be readily visible to players positioned to play the game. However, this would raise the playing area of the third level to almost twice the distance it presently sits above the surface upon which it rests, which may place the third level above the field of vision of players who wished to play the game while seated at a table with the game board on the table, and this is the position from which most people play board games (i.e. seated at a table with the game resting on the table in front of them). Alternatively, if the game board illustrated in FIG. 1 were constructed with its three levels in vertical alignment and with the total height of the game board kept to that of the game board illustrated in FIG. 1, that might require reducing the vertical distance between the second and third levels to approximately half of the present vertical distance between the second and third levels, and placing the second level approximately the same said half distance above the first level. The end result would be that the third level would obscure the Players' views of portions of the second level, and the second level would obscure the Players' views of portions of the first level; additionally the ease with which the playing pieces could be moved about on the first and second levels would be reduced.

The shape of the third level, square with stepped pyramidal shaped recesses centrally located in its sides, facilitates viewing of the second level by Players positioned to play the game, by virtue of the fact that one can see portions of the second level through these recesses. Additionally, because the playing area of the first level lies outboard of the playing areas of the central levels and is spaced far enough horizontally from them the playing positions of the first level may be easily viewed by any player positioned to play the game, consequently the entire playing area of the game board may be easily seen by a player positioned to play the game.

The game board illustrated in FIG. 1 and previously described herein, also allows any playing position on any level to be quickly identified, and it may be quickly and easily determined if a playing position on any of the levels has a correponding playing position on any of the other levels, and if it does, the location of any such corresponding playing position may be quickly and easily determined. The just said advantages are obtained because each playing position on the second level of the game board is uniquely marked with corresponding playing positions on the other levels being similarily marked and with the markings being placed in a position in the playing positions that need not be covered from view by a playing piece placed in the playing positions, no matter which of the playing pieces is placed in which of the playing positions.

Due to the configuration of the playing area on each of the three levels of the game board of FIG. 1 previously described herein, the said game board may be divided at least into four equal portions thereby allowing four players to be positioned across from it such that each has an equal portion and configuration of the game board having an equal number and configuration of playing positions, before him. Additionally continuity of the playing position paths on each level of the game board is maintained (i.e. there are certain adjacent playing positions that form a continuous path on every level, with every playing position on every level either being on a continuous path of playing positions or being on a path of playing positions that connects with one of the continuous paths of playing positions on that level). An example of one such continuous path on each level is, on the first level the playing positions numbered 1 through 40 inclusive, on the second level 1 through 40 inclusive, on the third level the playing positions numbered 97 through 112 inclusive. Continuity of the playing positions' paths may be necessary to prevent playing positions on a given level from being inaccessible from other playing positions on that level. This is accomplished with no duplication of playing positions on the second and third levels and with a minimum of duplication of playing positions on the first level (the latter being due to the stepped pyramidal shape of the component playing areas of the first level). It therefore can be seen that one of the advantages and uses of stepped pyramidal component playing areas, as taught herein, is that they allow each component playing area to have the same number and configuration of playing positions while at the same time allowing for continuity of playing position paths and for duplication of playing positions to be kept to a minimum. Duplication of playing positions refers to having more than one physical location marked out on the playing area of a level representing the same playing position. The rules of the game will determine how the game will be played when duplicate playing positions are encountered during the playing of the game, and is a factor not relevant to the present invention.

A further advantage of the preferred embodiment of a game board of the present invention, as hereinbefore described, is that due to the close fit of poles 26 in apertures 38 said poles are held firmly in place as this close fit has an effect like a clamping effect, and consequently the third level is held in place more firmly and more solidly then if, for example, poles 26 were free standing or simply attached to the upper surface of the second level.

It is not necessary to construct a three level game board identical to our preferred embodiment to obtain the major advantages of our invention. In order to obtain the major advantages of a game board according to the invention all that is necessary is that the game board be built as described in the aforesaid "Brief Summary of Invention". Additionally, however, it is also possible to obtain all of the advantages of the preferred embodiment by incorporating the features taught in the preferred embodiment.

Figure 2:
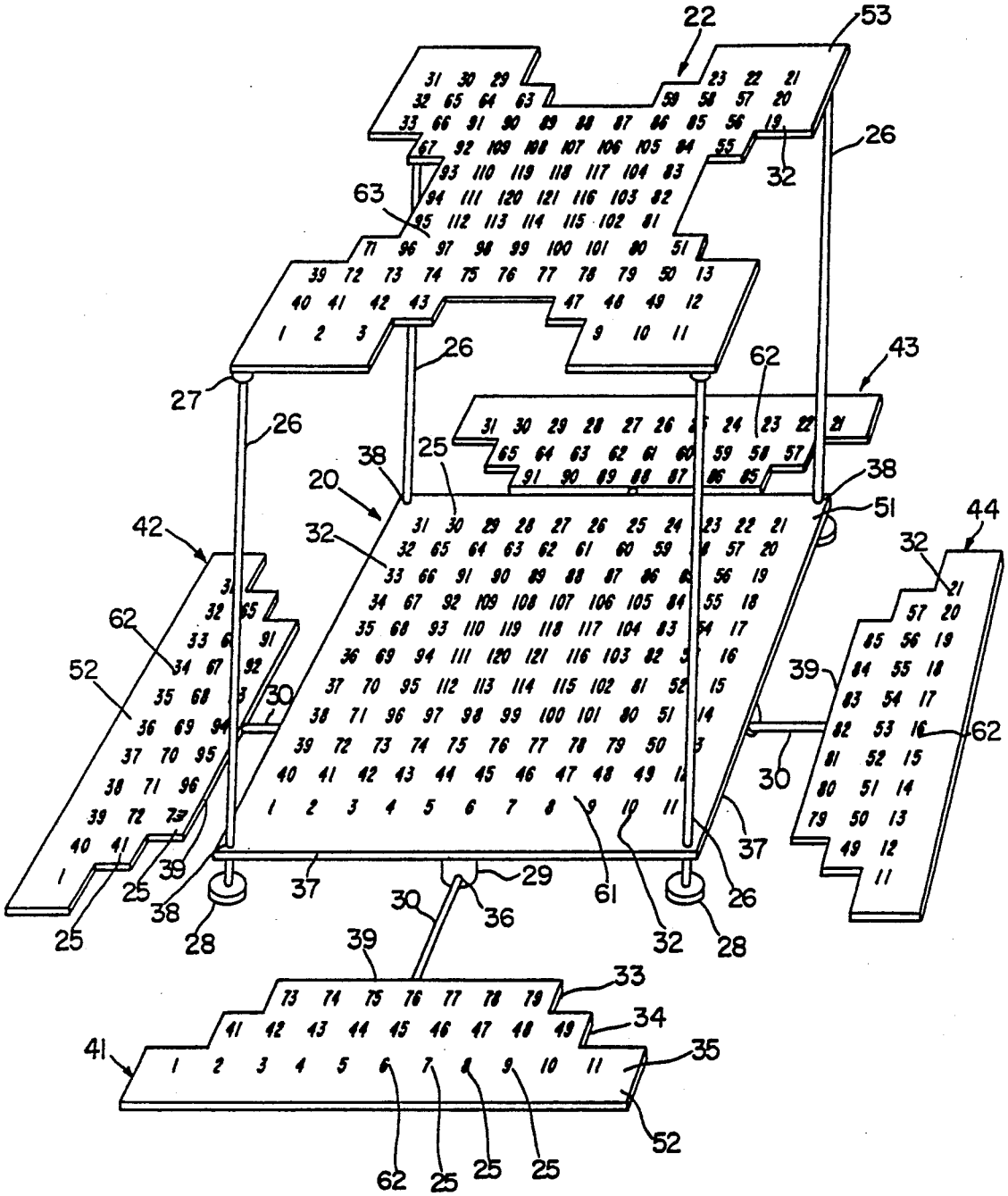
FIG. 2 is a perspective view of a second embodiment of a three level game board according to the invention.

FIG. 2 illustrates another embodiment of a three level game board according to the invention with all, except one, of the advantages previously stated herein for the preferred embodiment illustrated in FIG. 1. The exception is the advantage associated with all of the numbers 32 being able to remain uncovered by playing pieces. The game board illustrated in FIG. 2 is comprised of playing positions 25 which do not have boundary lines, but are instead identified by a number. A playing piece is on the playing position associated with a particular number when that playing piece is covering, or at least touching, that number. The component playing areas of the first level are each stepped pyramidal in shape and therefore the game board illustrated in FIG. 2 also has the advantages of having a first outboard lying level made up of stepped pyramidal shaped component playing areas. Finally the third level has stepped pyramidal shaped recesses centrally located in its sides, accordingly, the game illustrated in FIG. 2 also has the advantages associated with having a third level with stepped pyramidal shaped recesses centrally located in its sides.

The three level game board illustrated in FIG. 3 looks almost identical to the preferred embodiment illustrated in FIG. 1, with only two differences. Firstly, the three level game board illustrated in FIG. 3 has additional non-playable locations marded out on it in the form of X's as indicated at 100. Accordingly, the FIG. 3 game board has all of the advantages of the preferred embodiment. Alternatively, the non-playable locations could be located at other positions in the playing areas, and there could be a few more or a few less non-playable locations. A further variation could be that level 322 in FIG. 3 could be supported by a single pole placed on the central non-playable location of level 320, which is marked by a large "X". Secondly, there are no spacer rods. The players simply place the component parts of the first level at whatever distance away from the central levels they deem advisable. Other variations within the invention will also be obvious to those skilled in the art.

Figure 4:
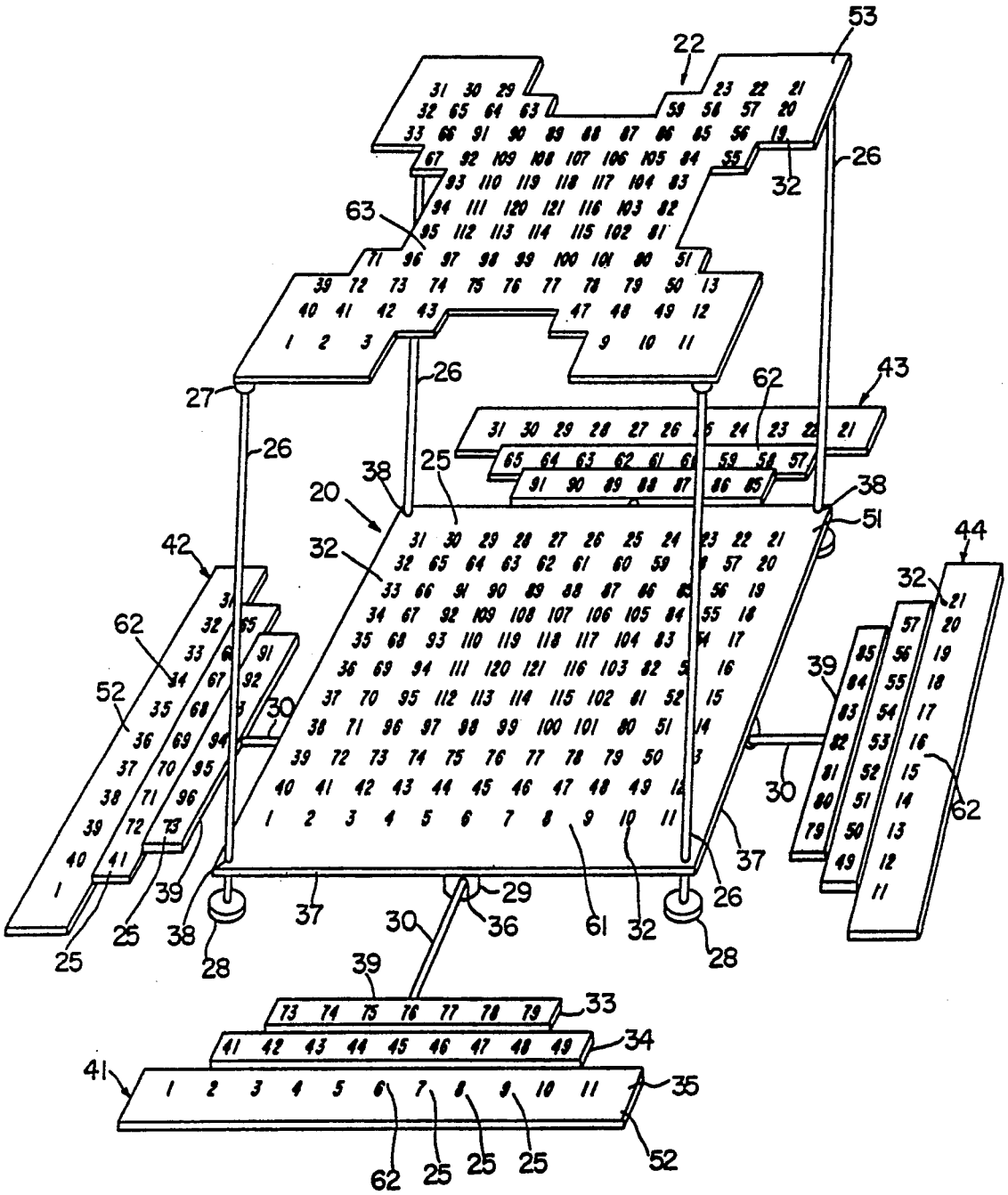
FIG. 4 is a perspective view of a fourth embodiment of a three level game board according to the invention.

There are only two differences between the embodiment illustrated in FIG. 2 and the embodiment illustrated in FIG. 4; in the FIG. 4 embodiment the rows 34 and 33 step up from the rows 35 (i.e. each row 34 is raised above each row 35 and each row 33 is raised above each row 34). The second difference is that the recesses 36 are each located up from the bottom of the legs 29. FIG. 4, accordingly, illustrates an embodiment in which one of the levels (in that example the first level) is itself of verying height.

It can be seen that there are many other embodiments of three level game boards that could be made following our invention, and that only some of those embodiments were illustrated in the drawings.

We wish to caution you, however, that the larger the number of playing positions the larger the game board will be, and there will obviously come a point at which even our invention will result in a game board that is difficult to play on. We recommand that the game board not have more than 16 playing positions (or their equivalent) in any row or column.

It should also be noted that the means to support the third level above the second level need not always be four support poles. One, two, or three support poles could also be used, or a platform attached to one or more poles could be used. Any suitable means, in fact, could be used.

It should also be noted that the second level does not have to be spaced vertically above the first level to construct a three level game board according to our invention, since the setting outboard of the component playing areas of the first level effectively makes them a separate level whether or not they are spaced vertically from the other levels.

It should also be noted that if one is going to attach the four component playing areas of the first level to the second level of the three level game board, this need not be done as illustrated in FIG. 1, any suitable means could be used, even a flexible means such as a rope if that is deemed suitable.

It can therefore be seen that there are a multitude of game board designs that are within the scope of this invention, some of which will also contain some or all of the features and variations taught and explained herein. Accordingly, many designs of game boards can now be made using this invention which will not look like the embodiments illustrated in FIGS. 1 to 4 hereof, however, which on examination will be seen to be within the scope of this invention and the following claims.

We claim:

1. A three level game board comprised of:

(a) playing positions;

(b) a lowermost level;

(c) a middle level;

(d) an uppermost level;

(e) wherein the playing area of the lowermost level is made up of four stepped pyramidal shaped component playing areas each of which is made up of some of the playing positions and each of which lies entirely outboard of the playing areas of the other two levels when the game board is set up for its intended use;

(f) wherein the playing area of the middle level is made up of some of the playing positions and is substantially square shaped as is centrally located entirely within the four component playing areas of the lowermost level when the game board is set up for its intended use;

(g) wherein the playing area of the uppermost level is made up of some of the playing positions and is substantially in the shape of a square that has had a stepped pyramidal shaped portion taken centrally out of each of its sides such that a stepped pyramidal shaped recess is centrally located in each of its sides;

(h) means to vertically space the uppermost level's playing area above the middle level's playing area such that the playing area of the uppermost level is centrally located entirely within the four component playing areas of the lowermost level and is vertically spaced above the playing areas of the middle and lowermost levels when the game board is set up for its intended use, and such that the uppermost level will be an appropriate distance above the middle level to allow easy visibility of the middle and uppermost levels' playing areas by players positioned to play the game for which the game board was designed, when the game board is set up for its intended use; and (i) wherein the four component playing areas of the lowermost level are adapted to lie entirely outboard of the middle and uppermost levels' playing areas when the game board is set up for its intended use in such a manner that if a first of said component playing areas is said to be lying entirely to the north of the middle and uppermost levels' playing areas, then a second of said component playing areas is lying entirely to the east of the middle and uppermost levels' playing areas and a third of said component playing areas is lying entirely to the south of the middle and uppermost levels' playing areas, and the fourth of said component playing areas is lying entirely to the west of the middle and uppermost levels' playing areas.

2. A three level game board as defined in claim 1, that is additionally comprised of numbers, wherein many of the playing positions on the middle level each have one of said numbers of a different numberical value associated with them, and wherein at least some of the playing positions on each level correspond to at least some of the playing positions on each other level, and wherein some of the corresponding playing positions on the various levels each have one of said numbers associated with them that is of the same numerical value as the number associated with the playing position to which it corresponds.

3. A three level game board as defined in claim 2 which is further comprised of means to vertically space the middle level's playing area above the lowermost level's playing area a small fraction of the distance that the uppermost level's playing area is vertically spaced above the middle level's playing area, when the game board is set up for its intended use.

4. A three level game board as defined in claim 1, that is additionally comprised of numbers, wherein each of the playing positions on the middle level has one of said numbers of a different numerical value associated with it, and wherein at least some of the playing positions on each level correspond to at least some of the playing positions on each other level, and wherein some of the corresponding playing positions on the various levels each have one of said numbers associated with them that is of the same numerical value as the number associated with the playing position to which it corresponds.

5. A three level game board as defined in claim 4 which is further comprised of means to vertically space the middle level's playing area above the lowermost level's playing area a small fraction of the distance that the uppermost level's playing area is vertically spaced above the middle level's playing area, when the game board is set up for its intended use.

6. A three level game board as defined in claim 1, which is further comprised of means to vertically space the middle level's playing area above the lowermost level's playing area a small fraction of the distance that the uppermost level's playing area is vertically spaced above the middle level's playing area, when the game board is set up for its intended use.

7. A three level game board comprised of:

(a) playing positions;

(b) a first level the playing area of which is comprised of four component playing areas, wherein each of the component playing areas is of a substantially stepped pyramidal shape defined by an outermost row of playing positions which has a length approximately equal to the length of eleven playing positions, a middle row of playing positions which has a length approximately equal to the length of nine playing positions, which middle row is centrally located adjacent the inside edge of said outermost row, and an innermost row of playing positions which has a length approximately equal to the length of seven playing positions, which innermost row is centrally located adjacent the inside edge of said middle row;

(c) a second level having a substantially square shaped playing area defined by playing positions which are arranged into adjacent rows and columns each of which has a length approximately equal to the length of eleven playing positions;

(d) a third level having a playing area substantially in the shape of a square that has apertures in each of its outer central portions which apertures are each in the shape of a stepped pyramidal configuration of playing positions, said third level's playing area being defined by playing positions which are arranged into a first row and an eleventh row each of which has a length approximately equal to the length of eleven playing positions and an aperture centrally located in it approximately equal to the length of five playing positions, a second row and a tenth row each of which has a length approximately equal to the length of eleven playing positions and an aperture centrally located in it approximately equal to the length of three playing positions, a third row and a ninth row each of which has a length approximately equal to the length of eleven playing positions and an aperture centrally located in it approximately equal to the length of one playing position, a fourth row and an eight row each of which has a length approximately equal to the length of nine playing positions, a fifth row and a seventh row each of which has a length approximately equal to the length of seven playing positions, a sixth row which has a length approximately equal to the length of five playing positions, wherein each of the second to eleventh rows, inclusive, is centrally located adjacent to the inside edge of the row preceding it;

(e) wherein the component playing areas of the first level are adapted to lie entirely outboard of the playing areas of the second and third levels when the three level game board is set up for its intended use in such a manner that if a first of said component playing areas is said to be lying entirely to the north of the second and third levels' playing areas, then a second of said component playing areas is lying entirely to the east of the second and third levels' playing areas and a third of said component playing areas is lying entirely to the south of the second and third levels' playing areas, and the fourth of said component playing areas is lying entirely to the west of the second and third levels' playing areas;

(f) wherein at least some of the playing positions on each level correspond to at least some of the playing positions on each other level;

(g) visible markings comprising of, wherein many of the playing positions on each of the three levels of the game board has a visible marking associated with it, and wherein there is no playing position on the second level that has the same visible marking associated with it as does any other playing position on the second level, and additionally wherein each playing position of the first and third levels that has a visible marking associated with it has the same visible marking associated with it as does the playing position on the second level to which it corresponds; and (h) means to support the third level sufficiently above the second level such that the third level will be an appropriate distance above the second level to allow easy visibility of the second and third levels' playing areas by players positioned to play the game for which the game board was designed when the game board is set up for its intended use.

8. A three level game board as described in claim 7 wherein there are sufficient visible markings for each of the playing positions on each of the three levels of the game board to have a visible marking associated with it, and wherein each of the playing positions on each of the three levels of the game board has a visible marking associated with it.

9. A three level game board as described in claim 7 wherein there are sufficient visible markings for each of the playing positions on each of the three levels of the game board to have a visible marking associated with it, and wherein each of the playing positions on each of the three levels of the game board has a visible marking associated with it, and wherein the means to support the third level above the second level are: four support poles, each of which is of the same length, four pole sockets each of which has a recess in its lower end which recesses are all of the same fixed depth and all have a cross-sectional measurement of a suitable dimension that one of said support poles fits closely within it; four flat bottomed pole bases, each of which is able to be attached to the bottom of one of said support poles; a bordering area outboard of each of the corners of the playing area of the second level, with apertures in each of the four outer corners of said bordering area, each of which apertures is of a cross-sectional measurement of a suitable dimension that a support pole would pass closely through it; and a bordering area external of each of the four outermost corners of the playing area of the third level, wherein the lower surfaces of said bordering areas are able to have a pole socket attached to them.

10. A three level game board as described in claim 7 which is further comprised of:

(i) four legs of the same length each of which is adapted to be attached to the lower surface of the second level near its outer portions, said length being such that when the second level is supported on said legs it is raised above its supporting surface only a small fraction of the distance that the third level is raised above the second level, when the game board is set up for its intended use;

(ii) wherein the lower surface of the second level is able, near its outer portions, to receive four legs on which the second level may be supported; and (iii) wherein there are sufficient visible markings comprised of numbers for each of the playing positions on each of the three levels of the game board to have a visible marking associated with it, and wherein each of the playing positions on each of the three levels of the game board has a visible marking associated with it; and (iv) wherein the means to support the third level above the second level are: four support poles, each of which is of the same length, four pole sockets each of which has a recess in its lower end which recesses are all of the same fixed depth and all have a cross-sectional measurement of a suitable dimension that one of said support poles fits closely within it; four flat bottomed pole bases, each of which is able to be attached to the bottom of one of said support poles; a bordering area outboard of each of the corners of the playing area of the second level, with apertures in each of the four outer corners of said bordering area, each of which apertures is of a cross-sectional measurement of a suitable dimension that a support pole would pass closely through it; and a bordering area external of each of the four outermost corners of the playing area of the third level, wherein the lower surfaces of said bordering areas are able to have a pole socket attached to them.

11. A three level game board as described in claim 7 which is further comprised of:

(i) four legs of the same length, said length being such that when the second level is supported on said legs it is raised above its supporting surface only a small fraction of the distance that the third level is raised above the second level, when the game board is set up for its intended use, wherein each of said legs have a recess in them of a predetermined depth, and wherein each of the legs is adapted such that it may be attached to the lower surface of the second level near one of its outer central portions such that the recess is facing outwardly;

(ii) wherein the lower surface of the second level is able to, near its outer central portions, receive four legs on which the second level will be supported;

(iii) wherein there are sufficient visible markings comprised of numbers for each of the playing positions on each of the three levels of the game board to have a visible marking associated with it, and wherein each of the playing positions on each of the three levels of the game board has a visible marking associated with it;

(iv) wherein the means to support the third level above the second level are: four support poles, each of which is of the same length, four pole sockets each of which has a recess in its lower end which recesses are all of the same fixed depth and all have a cross-sectional measurement of a suitable dimension that one of said support poles fits closely within it; four flat bottomed pole bases, each of which is able to be attached to the bottom of one of said support poles; a bordering area outboard of each of the corners of the playing area of the second level, with apertures in each of the four outer corners of said bordering area, each of which apertures is of a cross-sectional measurement of a suitable dimension that a support pole would pass closely through it; and a bordering area external of each of the four outermost corners of the playing area of the third level, wherein the lower surfaces of said bordering areas are able to have a pole socket attached to them;

(v) wherein each of the component playing areas of the first level is a separate unit hereinafter called a component part of the first level, wherein each of the component parts of the first level has a recess of a predetermined depth centrally located in its front edge; and (vi) four spacer rods each of which is adapted to fit at one end into the recess in one of the four legs and at the other end into the recess in one of the four aforesaid component parts of the first level, and which when so inserted will space the component parts of the first level an appropriate distance entirely outboard of the second and third levels such that when the game board is set up for its intended use a Player positioned to play the game will be able to see most of the playing area of the first level without much head or neck movement.

12. A three level game board comprised of:

(a) three-hundred and fourteen playing positions;

(b) a first level the playing area of which is comprised of four component playing areas, wherein each of the component playing areas is of a substantially stepped pyramidal shape defined by an outermost row of eleven of said playing positions, a middle row of nine of said playing positions adjacent the inside edge of, and centrally located on said outermost row of playing positions and an innermost row of seven of said playing positions adjacent the inside edge of, and centrally located on said middle row;

(c) a second level having a substantially square shaped playing area on its upper surface defined by one hundred and twenty-one of said playing positions which are arranged into adjacent rows and columns of eleven playing positions each;

(d) a third level having a playing area that would be substantially square in shape if it were not that the outermost central portions of the playing area of the third level are absent a stepped pyramidal configuration of playing positions, said third level playing area being defined by eighty-five of said playing positions which are arranged into a substantially square shaped central area of five adjacent rows and five adjacent columns of five playing positions each, two rows of ten playing positions each, each of said rows having a central aperture, that constitutes a non-playable location, whose size is equal to the dimensions of one of said playing positions, one of said rows being located adjacent the outside edge of each of the outermost rows of the central area and centrally located in relation to them, two rows of eight playing positions each, each of said rows having a central aperture, that constitutes a non-playable location, whose size is equal to the width of one of said playing positions and the length of three of said playing positions, one of said rows being located adjacent the outside edge of each of the rows of ten playing positions and centrally located in relation to them, two rows of six playing positions each, each of said rows having a central aperture, that constitutes a non-playable location, whose size is equal to the width of one of said playing positions and the length of five of said playing positions, one of said rows being located adjacent the outside edge of each of the rows of eight playing positions and centrally located in relation to them, two columns of ten playing positions each, each of said columns having a central aperture, that constitutes a non-playable location, whose size is equal to the dimensions of one of said playing positions, one of said columns being located adjacent the outside edge of each of the outermost columns of the aforesaid central area of five rows and five columns and centrally located in relation to said outermost columns, two columns of eight playing positions each, each of said columns having a central aperture, that constitutes a non-playable location, whose size is equal to the width of one of said playing positions and the length of three of said playing positions, one of said columns being located adjacent the outside edge of each of the columns of ten playing positions each and centrally located in relation to them, two columns of six playing positions each, each of said columns having a central aperture, that constitutes a non-playable location, whose size is equal to the width of one of said playing positions and the length of five of said playing positions, one of said columns being located adjacent the outside edge of each of the columns of eight playing positions each and centrally located in relation to them;

(e) wherein the component playing areas of the first level are adapted to lie outboard of the playing areas of the third and second levels when the three level game board is set up of its intended use in such a manner that if a first of said component playing areas is said to be lying entirely to the north of the second and third levels' playing areas, then a second of said component playing areas is lying entirely to the east of the second and third levels' playing areas and a third of said component playing areas is lying entirely to the south of the second and third levels' playing areas, and the fourth of said component playing areas is lying entirely to the west of the second and third levels' playing areas;

(f) wherein at least some of the playing positions on each level correspond to at least some of the playing positions on each other level;

(g) visible markings comprising a number, one of said visible markings being associated with each playing position on each of the levels, there being no playing position on the second level that has the same visible marking associated with it as any other playing position on the second level, and additionally such that the visible markings associated with the playing positions of the first and third levels are the same as the visible markings associated with the corresponding playing positions of the first level;

(h) means to support one of the first and second levels above the other of the first and second levels;

(i) wherein the second level is further comprised of a bordering area outboard of each of the corners of its playing area with apertures in said bordering areas large enough for a support pole to pass through, and wherein the lower surface of said level is able, near its outer portions, to receive four legs on which the level will be supported; and wherein the third level is further comprised of a bordering area external of each of the four outermost corners of its playing area, and wherein the lower surfaces of said bordering areas of the third level are able to have a suitable pole socket attached to them; and which is further comprised of four support poles of substantially the same length, said length being such that when the third level is supported by said support poles above the second level, it will be a sufficient distance above said level to permit a person positioned to play the game for which the three level game board is intended, to easily observe the entire playing areas of both the third and second levels, and wherein said support poles are sturdy enough to support the third level, and wherein each of the support poles is of a suitable width to allow it to pass through one of the apertures aforesaid in the second level; and which is further comprised of four legs of substantially the same length each of which is adapted to be attached to the lower surface of the second level near its outer portions, said length being such that when the second level is supported on said legs it is raised above its supporting surface only a small fraction of the distance that the third level is raised by the support poles; and which is further comprised of four suitable pole sockets each of which is suitable to be attached to the lower surfaces of the third level beneath one of the bordering areas of one of the outermost corners of the playing area of the third level, and wherein each of the pole sockets has a recess in its lower end which recess is of a fixed depth and has a cross-sectional measurement of a suitable dimension that one of said support poles fits closely within it; and which is further comprised of four flat bottomed pole bases, each of which is able to be attached to the bottom of one of said support poles; and;

(j) wherein the lower surface of the second level is able to, near its outer central portions, receive four legs on which the second level will be supported; and wherein each of the component playing areas of the first level is a seperate unit hereinafter called a component part of the first level; and wherein each of the component parts of the first level has a recess of a determined depth centrally located in its front edge; and wherein the legs each have a recess in them adjacent their bottom edge of a predetermined depth, each of the legs being adapted such that it may be attached to the lower surface of the first level near one of its outer central portions such that the recess is facing outwardly; and which is further comprised of four spacer rods each of which is adapted to fit at one end into the recess in one of the four legs and at the other end into the recess in one of the four aforesaid component parts of the first level.

* * * * *